US008899252B2

(12) United States Patent
Yang et al.

(10) Patent No.: US 8,899,252 B2
(45) Date of Patent: Dec. 2, 2014

(54) TENT

(75) Inventors: Weidong Yang, Fujian (CN); Pil Yul Lee, Fujian (CN); Keong Woong Youn, Washington, MO (US)

(73) Assignee: Seina International LLC, Labadie, MO (US)

( * ) Notice: Subject to any disclaimer, the term of this patent is extended or adjusted under 35 U.S.C. 154(b) by 502 days.

(21) Appl. No.: 12/982,238

(22) Filed: Dec. 30, 2010

(65) Prior Publication Data

US 2011/0155198 A1 Jun. 30, 2011

(30) Foreign Application Priority Data

Dec. 31, 2009 (CN) ..... 2009 2 0319386 U

(51) Int. Cl.
*E04H 15/58* (2006.01)
*E04H 15/14* (2006.01)
*E04H 15/32* (2006.01)

(52) U.S. Cl.
CPC ..... *E04H 15/14* (2013.01); *E04H 15/32* (2013.01)
USPC ..... 135/117; 135/93; 135/120.1

(58) Field of Classification Search
USPC ..... 135/91, 93, 155, 117, 120.1
See application file for complete search history.

(56) References Cited

U.S. PATENT DOCUMENTS

| | | | | |
|---|---|---|---|---|
| 5,579,799 | A * | 12/1996 | Zheng | 135/126 |
| 5,794,385 | A * | 8/1998 | Donovan | 52/36.4 |
| 6,543,465 | B2 * | 4/2003 | Choi | 135/120.1 |
| 6,763,841 | B1 * | 7/2004 | Cantwell | 135/117 |
| 7,128,077 | B2 * | 10/2006 | Cantwell | 135/93 |
| 7,191,788 | B2 * | 3/2007 | Holub et al. | 135/93 |
| 2003/0066551 | A1 * | 4/2003 | Sofie et al. | 135/121 |
| 2004/0250846 | A1 * | 12/2004 | Cantwell | 135/117 |
| 2006/0266400 | A1 * | 11/2006 | Cantwell | 135/117 |
| 2008/0264461 | A1 * | 10/2008 | Harris | 135/120.1 |

* cited by examiner

*Primary Examiner* — David R Dunn
*Assistant Examiner* — Danielle Jackson
(74) *Attorney, Agent, or Firm* — Armstrong Teasdale LLP

(57) ABSTRACT

A tent is provided. The tent includes a tarp having a plurality of walls and a platform oriented substantially perpendicularly to at least one of the walls. At least a portion of the platform is coupled to the tarp.

14 Claims, 7 Drawing Sheets

TENT

CROSS REFERENCE TO RELATED APPLICATIONS

This application claims the benefit of Chinese Patent Application 200920319386.7 entitled "A Tent" filed on Dec. 31, 2009, which is hereby incorporated by reference in its entirety.

BACKGROUND OF THE INVENTION

The field of the invention relates generally to a tent or, more specifically, to a tent including a window opening that includes a windowsill.

Known tents include a tent frame and a tarpaulin or a tarp extending over the tent frame. At least some known tarps have a window opening extending therethrough to provide visibility and/or ventilation for the tent.

Typically, articles are placed and/or stored on a floor of the tent. Storing articles on the floor of the tent, over time, may clutter the space within the tent, leading to an uncomfortable lodging condition and/or articles being damaged.

BRIEF DESCRIPTION OF THE INVENTION

In one aspect, a tent is provided. The tent includes a tarp including a window opening defined therethrough. The window opening is defined by at least a first edge and a second edge of the tarp. A cover is coupled to the first edge of the tarp, such that the cover extends outwards from the tarp. A platform is coupled to the second edge of the tarp and to the cover, such that the platform is oriented substantially perpendicularly to at least a portion of said tarp and extends outwards from the tarp.

In another aspect, a tent is provided. The tent includes a tarp having a plurality of walls and a platform oriented substantially perpendicularly to at least one of the walls. At least a portion of the platform is coupled to the tarp.

The features, functions, and advantages that have been described can be achieved independently in various embodiments of the present invention or may be combined in yet other embodiments further details of which can be seen with reference to the following description and drawings.

DETAILED DESCRIPTION OF THE INVENTION

The present disclosure is directed to a tent including a tarp having a window opening and a convex window extending from the window opening. The convex window includes a cover and a platform. The platform may be used for storing and/or placing articles such as snacks, cosmetics, and/or a computer. As such, the platform enables a comfortable lodging condition to be provided.

Figure 1:
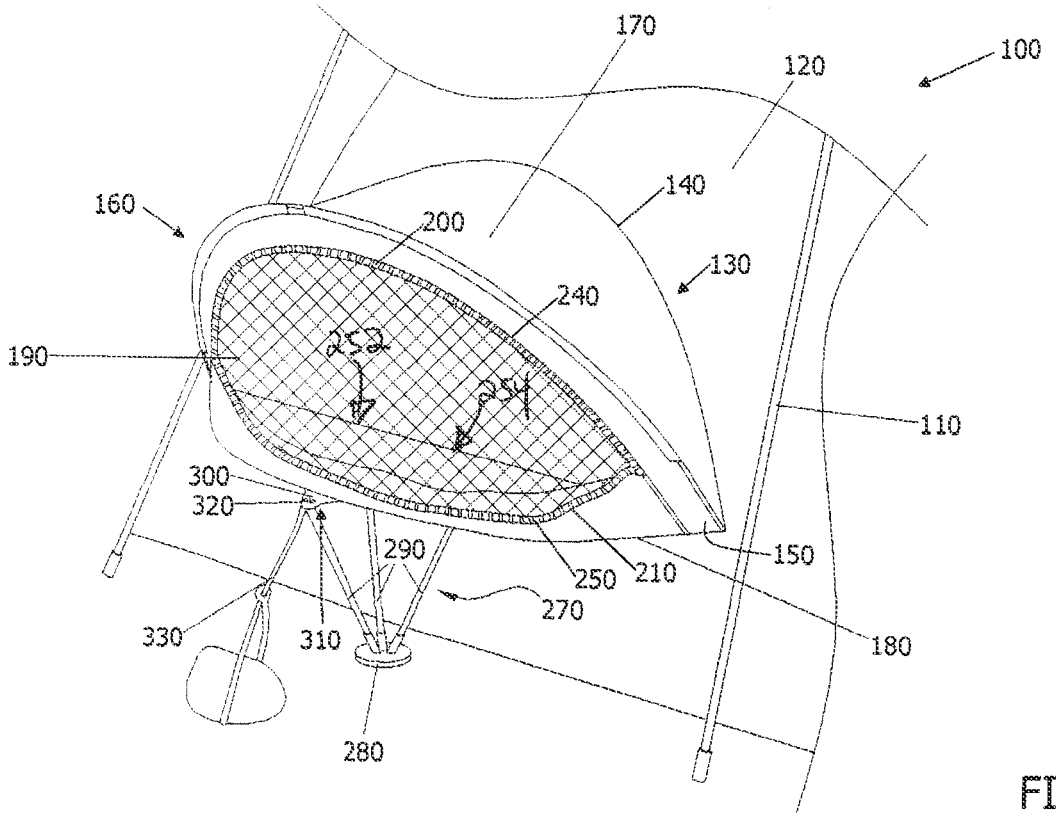
FIG. 1 is an external view of an exemplary tent.
Figure 2:
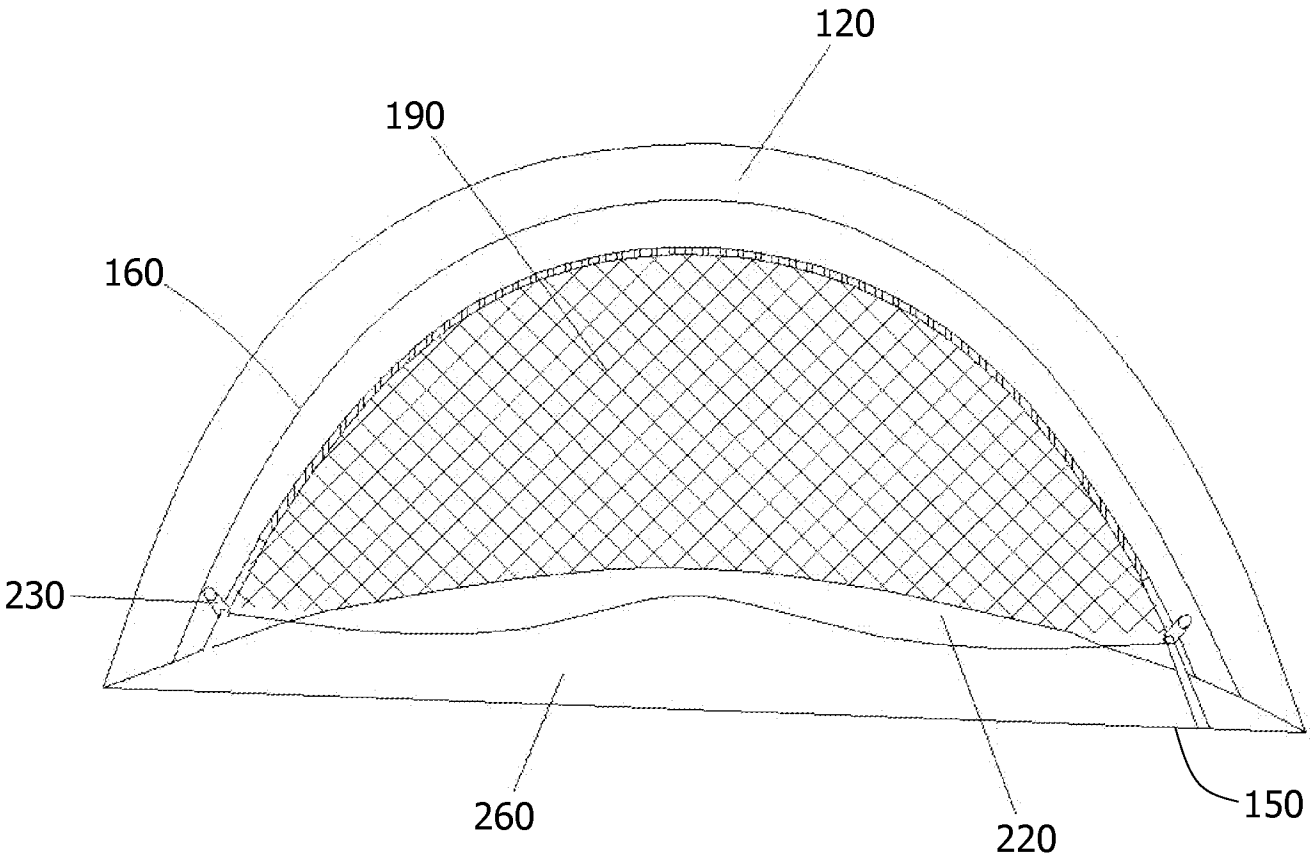
FIG. 2 is an internal view of the tent shown in FIG. 1.

FIGS. 1 and 2 illustrate a tent 100 including a tent frame 110 and a tarpaulin or a tarp 120 coupled to tent frame 110. In the exemplary embodiment, tarp 120 includes a window opening 130 defined therethrough. More specifically, in the exemplary embodiment, at least a generally arched upper or first edge 140 and a generally linear lower or second edge 150 define window opening 130. Window opening 130 may have any size and/or shape that enables tent 100 to function as described herein.

In the exemplary embodiment, a convex window 160 extends outwards from tarp 120. More specifically, in the exemplary embodiment, convex window 160 includes a cover 170 coupled to first edge 140 and a windowsill or a supporting platform 180 coupled to second edge 150. As such, in the exemplary embodiment, cover 170 is generally arched along first edge 140, and platform 180 is generally linear along edge 150. In the exemplary embodiment, platform 180 provides a surface on which a user may place at least one article within tent 100.

In the exemplary embodiment, at least one piece of gauze 190 extends between cover 170 and platform 180 to enable visibility and/or ventilation to be provided for tent 100. More specifically, in the exemplary embodiment, gauze 190 is coupled to cover 170 along an upper or first seam 200 and to platform 190 along a lower or second seam 210.

In the exemplary embodiment, a waterproof cloth 220 extends between first seam 200 and second seam 210 to facilitate increasing privacy and/or protection for tent 100. More specifically, in the exemplary embodiment, cloth 220 is selectively coupled to first seam 200 and/or second seam 210. For example, in the exemplary embodiment, a coupling mechanism 230, such as a zipper, removably couples cloth 220 to cover 170 along first seam 200, and cloth 220 is generally securely coupled to platform 180 along second seam 210.

In the exemplary embodiment, an upper or first elastic bar 240 extends along first seam 200, and a lower or second elastic bar 250 extends along second seam 210 to facilitate securing and/or stabilizing platform 180 in a horizontal direction. Moreover, in the exemplary embodiment, elastic bars 240 and/or 250 facilitate increasing a usable area within tent 100. In the exemplary embodiment, a third elastic bar 252 is extendable along a seam 254 coupling tarp 120 to platform 180.

In the exemplary embodiment, a board 260 is selectively positioned on top of platform 180. In the exemplary embodiment, platform 180 and/or board 260 provides a surface on which a user may place at least one article. More specifically, in the exemplary embodiment, at least one mechanical fastener (not shown) hingedly couples an inner edge of board 260 to an inner edge of platform 180 to facilitate increasing an area of the surface on which a user may place at least one article within tent 100 and/or decreasing an amount of space occupied by board 260 within tent 100. Additionally or alternatively, a coupling mechanism (not shown) may be provided on an interior surface of tarp 120 to facilitate retaining board 260 in the retracted configuration.

In one embodiment, board 260 includes a plurality of component boards (not shown) and a coupling mechanism, such as a fixing and/or connecting bag including a plurality of component bags (not shown). In such an embodiment, the component bags enable a space to be provided between adjacent component boards. Moreover, in such an embodiment, each of the component boards is positioned within a respective component bag.

In the exemplary embodiment, a support mechanism 270 is configured to stabilize and/or provide support to platform 180. In the exemplary embodiment, support mechanism 270 includes a base 280 and a plurality of supporting bars 290 extending between base 280 and platform 180. More specifically, in the exemplary embodiment, a lower end of at least one supporting bar 290 is coupled to base 280, and an upper end of at least one supporting bar 290 is coupled to platform 180. In the exemplary embodiment, at least one supporting bar 290 is pivotably coupled to base 280.

In the exemplary embodiment, platform 180 is configured to receive at least a portion of one supporting bar 290. In the exemplary embodiment, platform 180 includes a plurality of first slots 300 sized and/or oriented to receive supporting bars 290. For example, in the exemplary embodiment, platform 180 includes three first slots 300 sized and/or oriented to receive three supporting bars. More specifically, in the exemplary embodiment, a connecting part 310 having a first slot 300 is positioned proximate to a center of second edge 150, and a plurality of first slots 300 are symmetrically positioned about platform 180 on opposite sides of connecting part 310. Platform 180 may have any quantity of first slots 300 that enable tent 100 to function as described herein.

Moreover, in the exemplary embodiment, connecting part 310 has a second slot 320 sized and/or oriented to receive a pull rope 330 to facilitate providing support to board 260. More specifically, in the exemplary embodiment, an upper end of pull rope 330 extends through second slot 320, and a lower end of pull rope 330 is coupled to the ground.

Figure 3:
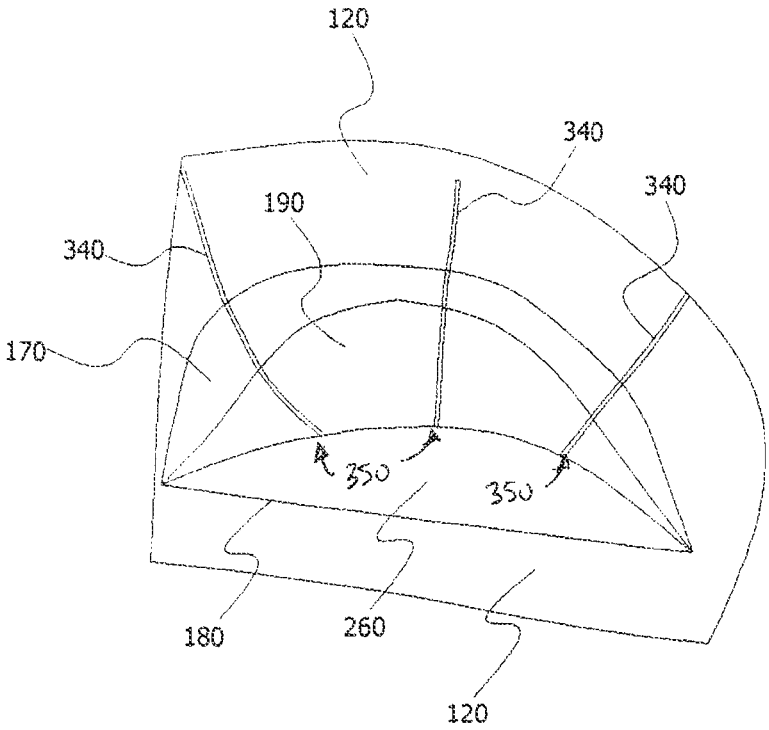
FIG. 3 is an internal view of an alternative embodiment of the tent shown in FIG. 1.
Figure 4:
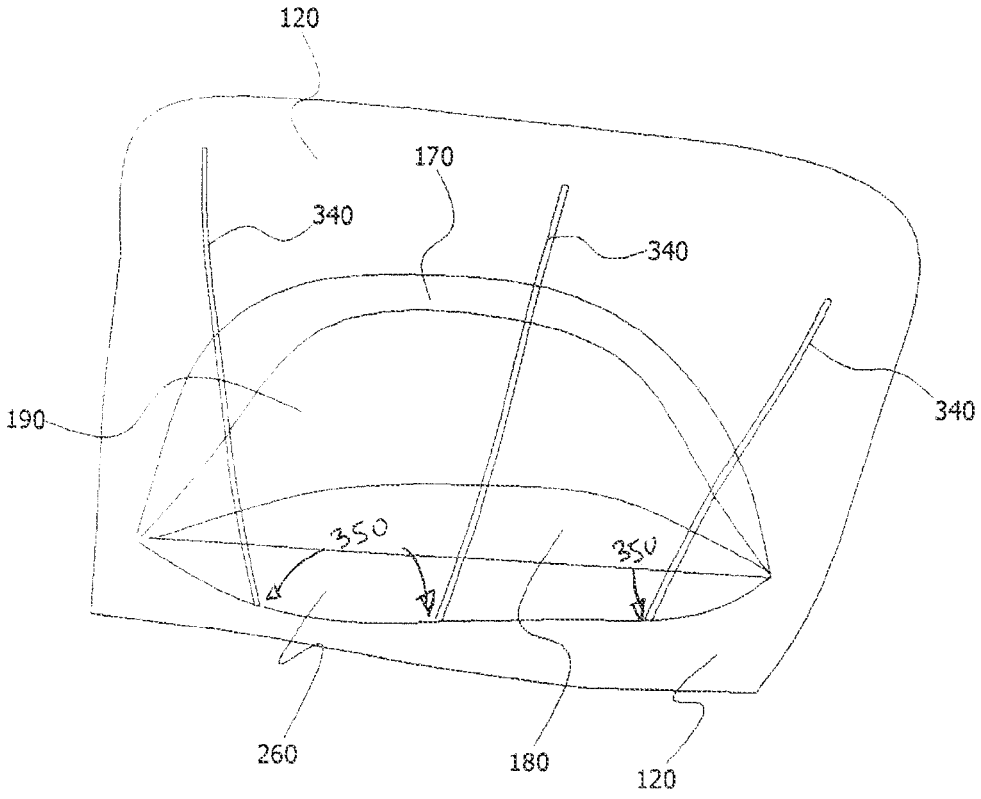
FIG. 4 is another internal view of the tent shown in FIG. 3.

FIGS. 3 and 4 illustrate another embodiment of tent 100. In the exemplary embodiment, support mechanism 270 includes a plurality of hanging ropes 340 extending between tarp 120 and a fixing bag and/or a coupling mechanism 350. More specifically, in the exemplary embodiment, an upper end of at least one hanging rope 340 is coupled to tarp 120 and a lower end of the at least one hanging rope 340 is coupled to an outer periphery of board 260. Board 260 may be selectively positioned between a retracted configuration, as shown in FIG. 3, and an extended configuration, as shown in FIG. 4. That is, FIG. 3 illustrates board 260 selectively positioned over and/or above platform 180, and FIG. 4 illustrates board 260 selectively positioned to facilitate increasing an area of the surface provided board 260 and/or platform 180.

Figure 5:
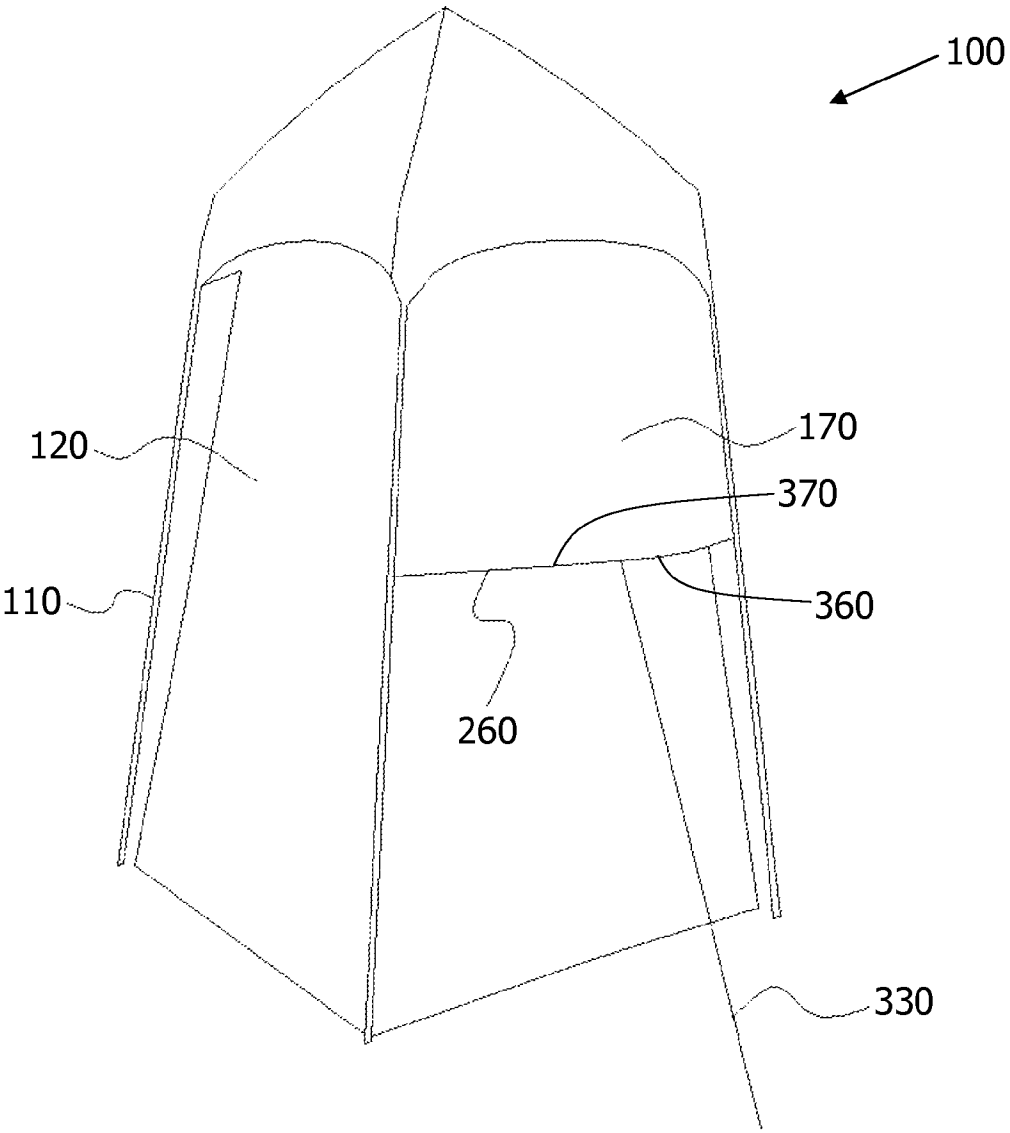
FIG. 5 is an external view of another alternative embodiment of the tent shown in FIG. 1.

FIG. 5 illustrates yet another embodiment of tent 100. In the exemplary embodiment, cover 170 is coupled to first edge 140 (shown in FIG. 1) of tarp 120, and platform 180 (shown in FIG. 1) is coupled to second edge 150 (shown in FIG. 1) of tarp 120. Moreover, in the exemplary embodiment, cover 170 is coupled to platform 180 along an edge 360. In the exemplary embodiment, an elastic bar 370 extends along edge 360 to facilitate securing and/or stabilizing platform 180 in a horizontal direction. Moreover, in the exemplary embodiment, elastic bar 370 facilitates increasing a usable area within tent 100.

Figure 6:
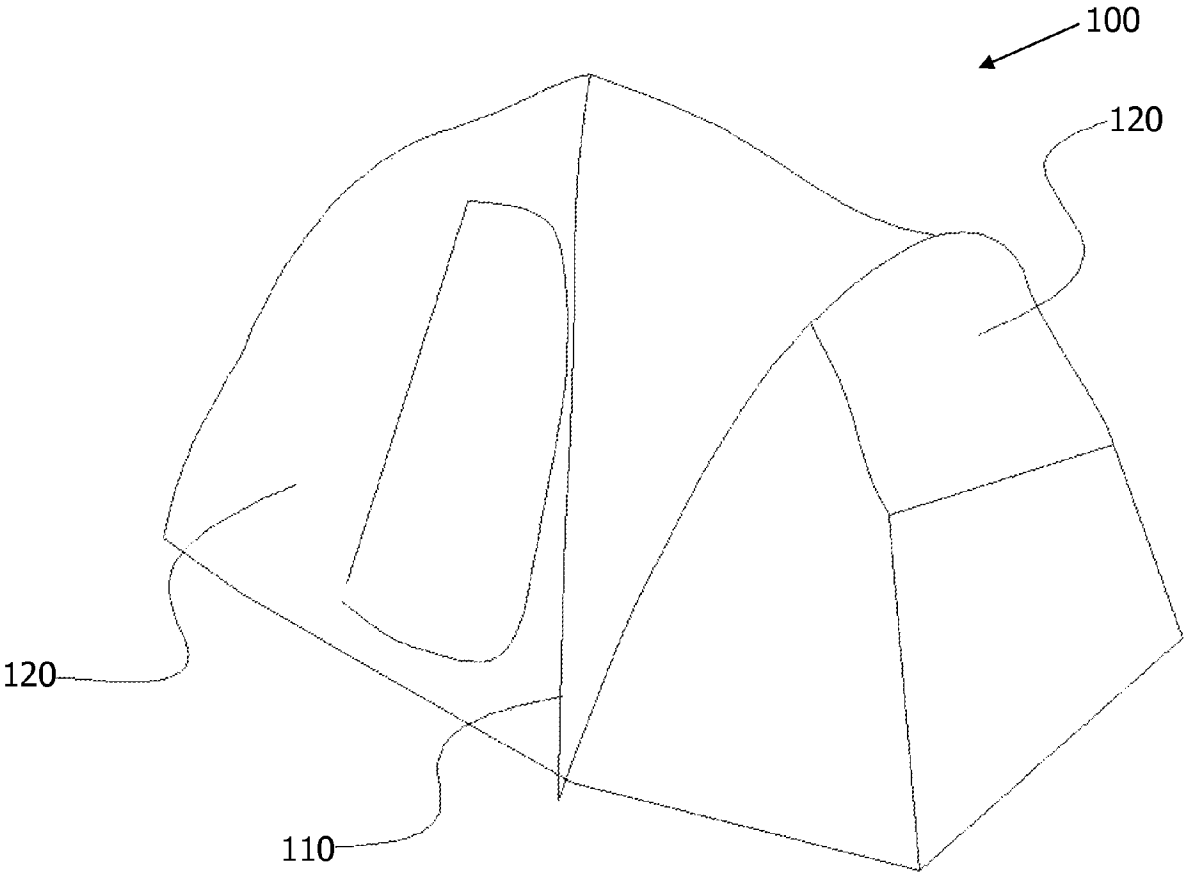
FIG. 6 is an external view of another alternative embodiment of the tent shown in FIG. 1.
Figure 7:
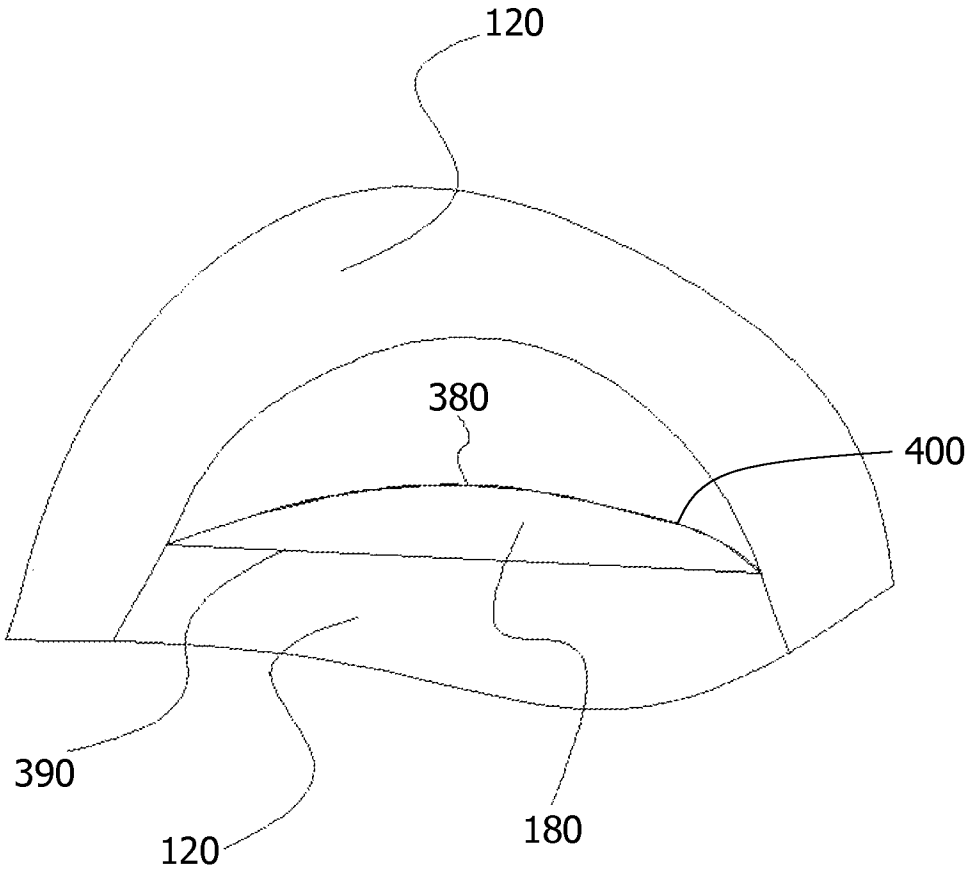
FIG. 7 is an internal view of the tent shown in FIG. 6.

FIGS. 6 and 7 illustrate yet another embodiment of tent 100. In the exemplary embodiment, platform 180 has a generally arched outer or first edge 380 and a generally linear inner or second edge 390. In the exemplary embodiment, first edge 380 is coupled to an internal surface of tarp 120 to facilitate securing and/or stabilizing platform 180 in a horizontal direction. Moreover, in the exemplary embodiment, an elastic bar 400 extends along first edge 380 to facilitate securing and/or stabilizing platform 180 in a horizontal direction.

The exemplary methods and systems described herein provide a tent with a surface to place and/or store articles. More specifically, the exemplary methods and systems provide a windowsill to place and/or store articles within a tent to facilitate enlarging a usable space within the tent. As such, articles such as snacks, cosmetics, or the like may be placed on the windowsill. Moreover, a small computer may be placed on the windowsill to provide a working space.

Exemplary embodiments of methods and systems are described and/or illustrated herein in detail. The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose certain embodiments of the present invention, including the best mode, and also to enable any person skilled in the art to practice those certain embodiments, including making and using any devices or systems and performing any incorporated methods. The patentable scope of the present invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tent comprising:

a tarp including a window opening defined therethrough, said window opening defined by at least a first edge and a second edge of said tarp;

a cover coupled to said first edge of said tarp, such that said cover is configured to extend outwards from said tarp;

a platform coupled to said second edge of said tarp and to said cover, said platform selectively positionable between a retracted configuration and an extended configuration, such that said platform is oriented substantially perpendicularly to at least a portion of said tarp and extends outwards from said tarp when said platform is in the extended configuration; and a support mechanism configured to provide support to said platform when said platform is in the extended configuration, said support mechanism comprising a base positionable substantially below said platform when said platform is in the extended configuration.

2. A tent as claimed in claim 1 further comprising:

a board positionable on top of said platform when said platform is in the extended configuration.

3. A tent as claimed in claim 2, wherein said board is hingedly coupled to said platform.

4. A tent as claimed in claim 2, wherein said board is removably coupled to said platform.

5. A tent as claimed in claim 1, wherein said support mechanism further comprises:

a plurality of supporting bars extendable between said base and said platform to provide support to said platform.

6. A tent as claimed in claim 5, wherein said platform comprises a connecting part defining a slot, wherein a first supporting bar of said plurality of supporting bars is sized to be inserted into said slot.

7. A tent as claimed in claim 6, wherein a second supporting bar and a third supporting bar of said plurality of supporting bars are positionable on opposite sides of said first supporting bar.

8. A tent as claimed in claim 6, wherein said connecting part is coupleable to a pull rope.

9. A tent as claimed in claim 1 further comprising an elastic bar extendable between said cover and said platform.

10. A tent as claimed in claim 1 further comprising:

gauze extendable between said cover and said platform, such that said cover is substantially above said gauze, said platform is substantially below said gauze when said platform is in the extended configuration, and said gauze is coupled to said platform along a seam; and an elastic bar extendable along said seam.

11. A tent comprising:

a tarp having a plurality of walls;

a platform oriented substantially perpendicularly to at least one of said plurality of walls when said platform is in an extended configuration, wherein at least a portion of said platform is coupled to said tarp; and a support mechanism configured to provide support to said platform when said platform is in the extended configuration, said support mechanism comprising a base positionable substantially below said platform when said platform is in the extended configuration.

12. A tent as claimed in claim 11 further comprising an elastic bar extendable along a seam coupling said tarp to said platform.

13. A tent comprising:

a tarp including a window opening defined therethrough, said window opening defined by at least a first edge and a second edge of said tarp;

a cover coupled to said first edge of said tarp, such that said cover is configured to extend outwards from said tarp;

a platform coupled to said second edge of said tarp and to said cover, said platform selectively positionable between a retracted configuration and an extended configuration, such that said platform is oriented substantially perpendicularly to at least a portion of said tarp and extends outwards from said tarp when said platform is in the extended configuration;

a support mechanism configured to provide support to said platform when said platform is in the extended configuration; and gauze extendable between said cover and said platform, such that said cover is substantially above said gauze, said platform is substantially below said gauze when said platform is in the extended configuration, and said gauze is coupled to said platform along a seam.

14. A tent as claimed in claim 13 further comprising an elastic bar extendable along said seam.

* * * * *